United States Patent [19]

Johns-Hunt

[11] 4,257,249

[45] Mar. 24, 1981

[54] COMBINATION LOCK

[75] Inventor: John Johns-Hunt, Wolverhampton, England

[73] Assignee: Chubb & Son's Lock and Safe Co., Ltd., London, England

[21] Appl. No.: 958,874

[22] Filed: Nov. 8, 1978

[30] Foreign Application Priority Data

Nov. 11, 1977 [GB] United Kingdom ..... 47110/77

[51] Int. Cl.[3] ..... E05B 37/08

[52] U.S. Cl. ..... 70/303 A

[58] Field of Search ..... 70/303 A, 317, 303 R, 70/316, 318, 315

[56] References Cited

U.S. PATENT DOCUMENTS

| | | | |
|---|---|---|---|
| 2,660,873 | 12/1953 | Bennett | 70/303 A |
| 3,045,467 | 7/1962 | Herlong | 70/303 A |
| 3,176,486 | 4/1965 | Richardson | 70/303 A |
| 4,106,316 | 8/1978 | Tippin | 70/303 A |

FOREIGN PATENT DOCUMENTS

| | | | |
|---|---|---|---|
| 200673 | 1/1956 | Australia | 70/303 A |
| 815654 | 7/1959 | United Kingdom . | |

*Primary Examiner*—Robert L. Wolfe

*Attorney, Agent, or Firm*—Andrus, Sceales, Starke & Sawall

[57] ABSTRACT

A combination lock includes an over-center mechanism for moving the fence of the lock between two alternative positions with a snap action, the over-center mechanism comprising a lever arm secured to the fence and turning about a pivot on the bolt assembly and a stressed spring connected at one end to the lever arm and at the other end to a member capable of movement between two positions in relation to the bolt assembly. In one of the two positions the line of action of the spring passes to one side of the pivot of the lever arm and in the other position it passes to the other side of the pivot, so that when the member moves from one position to the other the lever arm is biased to move the fence from one alternative position to the other. The member is controlled by rotation of the dial of the lock in such a way that the fence remains in the first of its two positions for the majority of a revolution of the dial, being moved to the second position, in which it is capable of responding to the gates in the combination wheels, only for the remaining small fraction of a revolution. In a lock in which the dial is mounted on a shaft offset from that carrying the combination wheels, the member capable of movement between two positions is controlled by the shaft carrying the dial, preferably by means of a flat on the shaft.

6 Claims, 5 Drawing Figures

COMBINATION LOCK

This invention relates to combination locks, that is to say locks of the type in which the bolt is moved by engagement between a projection on a drop arm forming part of the bolt assembly and a recess in a driver cam turned by the dial of the lock. Until the correct combination has been dialled this engagement is prevented by means of a probe or "fence" which is connected to the drop arm and which co-operates with notches or "gates" in the surface of the combination wheels of the lock. When the gates have all been aligned by correct operation of the dial of the lock, the fence is able to enter the gates and thus allows the projection on the drop arm to engage the recess in the driver cam. Subsequent references both in the specification and claims to a combination lock thus indicate a lock of this type.

All combination locks are susceptible to manipulation to a greater or lesser degree. The term "manipulation" is used in connection with such locks to mean the continued operation of the dial of the lock through successive steps in alternately opposite directions on a trial basis, as a result of which the manipulator gradually informs himself of the correct combination of the lock and can eventually open it. The ultimate aim of any method of manipulation is to determine the relative location of the fence of the lock and the gates in the respective wheels of the lock. This is made much easier if the fence is in contact with the periphery of one or more wheels of the lock during rotation and consequently, one known way of rendering manipulation more difficult is to raise the fence from the surface of one or more of the wheels during at least part of each revolution.

Most modern locks achieve this separation of wheel periphery and fence for a major proportion of each revolution by causing the drop arm to ride on the surface of the driver cam so that only for that portion of each revolution when the recess in the driver cam is beneath the drop arm is the fence able to fall to a position where it can contact the wheels. To achieve a greater resistance to manipulation even this limited arc of contact between fence and wheels must be reduced and one form of mechanism for achieving such a result is described in our prior British Pat. specification No: 815,654 and includes a snap-action mechanism which allows the fence to move into engagement with the wheels of the lock only when required by the operator, i.e. at the completion of the normal dialling operation.

In other words, the operator carries out the normal dialling procedure and at the completion of this operates the snap-action mechanism so as to move the fence into contact with the wheels of the lock and thus allow the bolt to be withdrawn by rotation of the dial in the usual way. As described in this earlier specification, release of the snap-action mechanism requires further operation of the dial followed by depression of the dial knob as a final step. If the combination has been correctly dialled and the wheel gates are aligned the fence moves downwards through a dead-centre position to a stable position and remains in this when the dial knob is released. However, if the wheel gates are not aligned, i.e. the correct combination has not been dialled, then the fence is unable to move sufficiently far to pass through the dead-centre position and when the dial knob is released the fence therefore returns to the up position.

The present invention is concerned with a combination lock in which the fence is also controlled by an over- centre mechanism to move with a snap action between two alternative positions. According to the invention, the over-centre mechanism comprises a lever arm secured to the fence and turning about a pivot on the bolt assembly and a stressed spring connected at one end to the lever arm and at the other end to a member capable of movement between two positions in relation to the bolt assembly, in one of which positions the line of action of the spring passes to one side of the pivot of the lever arm and in the other of which it passes to the other side of the pivot, so that when the member moves from one position to the other the lever arm is biased to move the fence from one alternative position to the other and the member is controlled by rotation of the dial of the lock in such a way that the fence remains in the first of its two positions for the majority of a revolution of the dial, being moved to the second position, in which it is capable of responding to the gates in the combination wheels, only for the remaining small fraction of a revolution.

As a consequence of such a construction, the advantage of having the fence held away from the surfaces of the combination wheels for all except a very minor proportion of the dialling operation is achieved without the need for any operational steps at all in addition to the normal dialling operation and by means of a lock having an external appearance no different from a similar lock without the additional facility just described. Consequently, in both appearance and dialling action, the lock is indistinguishable from one without the additional facility.

The dialling operation is carried out in the normal way until the gates in all the combination wheels are aligned. With a conventional lock, rotation of the dial in the appropriate direction then brings all the gates into register with the fence which is thus allowed to fall so that the projection on the associated drop arm engages the recess in the driver cam. Accordingly, the bolt of the lock can then be retracted by further rotation of the dial in the same direction. With a lock in accordance with the invention, rotation of the dial in the direction to retract the bolt will cause the dial to move through the position in which the fence is allowed to move to its second position, whereupon the fence will immediately move into the gates on the combination wheels and the nose portion of the drop arm will engage the driver so as to allow the bolt to be retracted. In other words, the improved effect is obtained by means of a sequence of operations identical with that for a normal lock.

A construction in accordance with the invention is particularly applicable to a combination lock of the off-set type, in which case the number capable of movement between two positions is controlled by the cam shaft of the lock. The member may, for example, engage directly with the surface of the cam shaft which may be formed with a localised flat or projection so as to produce the required movement of the member for a small fraction of a revolution. The stressed spring which controls the over-centre mechanism is preferably a tension spring connected to the lever arm at a point remote from its pivot and extending past the pivot of the lever arm to its point of connection to the two-position member. Movement of this member from one position to the other causes the spring to pass from one side to the other of the pivot of the lever arm and thus to produce the snap action already described.

A preferred construction of combination lock will now be described in more detail, by way of example, with reference to the accompanying drawings, in which.

Figure 1:
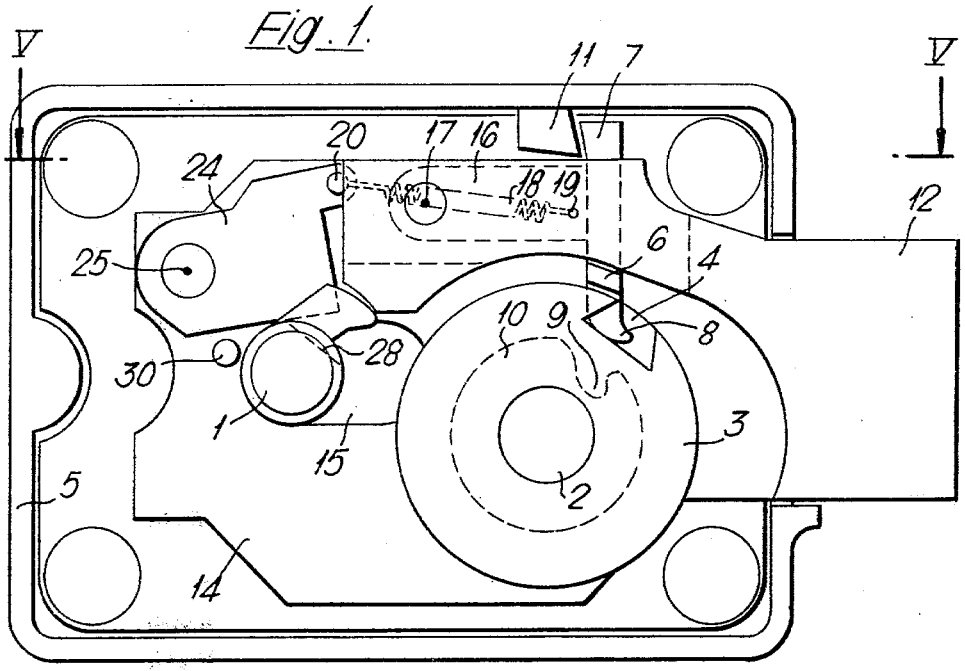
FIG. 1 is an elevation of the main operating components of a combination lock showing a fence in a raised position.

Turning first to FIG. 1, the major components of the lock are of standard construction and require little detailed description. The lock is of the offset type, having a dial D (shown in dotted lines only in FIG. 5) mounted on a cam shaft 1 which is connected by a 1:1 gear train (not shown) to a second shaft 2 carrying the combination wheels, only one of which is seen in FIGS. 1 to 4, and is indicated as 3, being formed with a gate 4. Both shafts turn in bearings in the casing 5 of the lock. A fence 6 is fixed to a drop arm 7 having a nose portion 8 for engagement with a recess 9 in a driver 10 mounted on the shaft 2. Accordingly, when the correct combination has been dialled, the fence 6 can enter the gates 4 in the successive combination wheels 3, thus allowing the drop arm 7 to fall so that its upper end clears a stop 11 and the nose portion 8 engages with the recess 9. Further rotation of the dial will then cause the driver 10 to retract the bolt which is shown as 12. As so far described, this construction is quite basic.

With such a basic construction, however, i.e. without any modern refinements such as mentioned previously, the fence 6 would be in engagement with the surfaces of the combination wheels 3 during the whole dialling process. As seen in FIG. 1, however, the fence 6 is raised clear of the surfaces of the wheels and driver by a mechanism which will now be described. The mechanism as a whole is mounted on a plate 14 which forms part of a unitary assembly including the bolt 12 and capable of sliding movement to the left from the position of FIG. 1, the plate 14 having a cut-out portion 15 around the shaft 1 to permit this movement. Consequently, when the bolt 12 is retracted, the plate 14 and the components mounted on it will also move to the left to the position shown in FIG. 4.

The mechanism controlling the position of the fence 6 is an over-centre mechanism comprising a lever arm 16 to which the drop arm 7 is fixed and which is pivoted at 17 to the plate 14. The lever arm 16 comprises two spaced portions between which a tension spring 18 extends from an anchorage point 19 adjacent the drop arm 7 to a point 20 on a two-position member 24 also constituted by a lever arm pivoted at 25 to the plate 14. In the position shown in FIG. 1, it will be seen that the centre-line of the tension spring 18 passes above the pivot point 17 of the lever arm 16.

The lever arm 24 rests against the surface of the cam shaft 1, against which it is biased by tension in the spring 18. In the region where it is engaged by the lever arm 24, the cam shaft 1 is formed with a flat 28 so that, as the shaft 1 is turned to bring the flat 28 into contact with the lever arm 24, the latter is progressively lowered to the position shown in FIG. 2. During this movement the spring 18 is lowered until its centre-line passes beneath the pivot 17 of the lever arm 16. In the position of FIG. 1, the tension in the spring 18 biases the lever arm 16 and hence the fence 6 and the drop arm 7 in an upward direction and in the position of FIG. 2 it biases these components in a downward direction. During the downward movement, a dead-centre position is reached in which the points 20, 17 and 19 are in a straight line and there is no bias in either direction, but during the movement of the spring through the pivot 17, the bias changes from an upward one to a downward one thus causing downward movement of the fence 6 and the drop arm 7 with a snap action.

Figure 2:
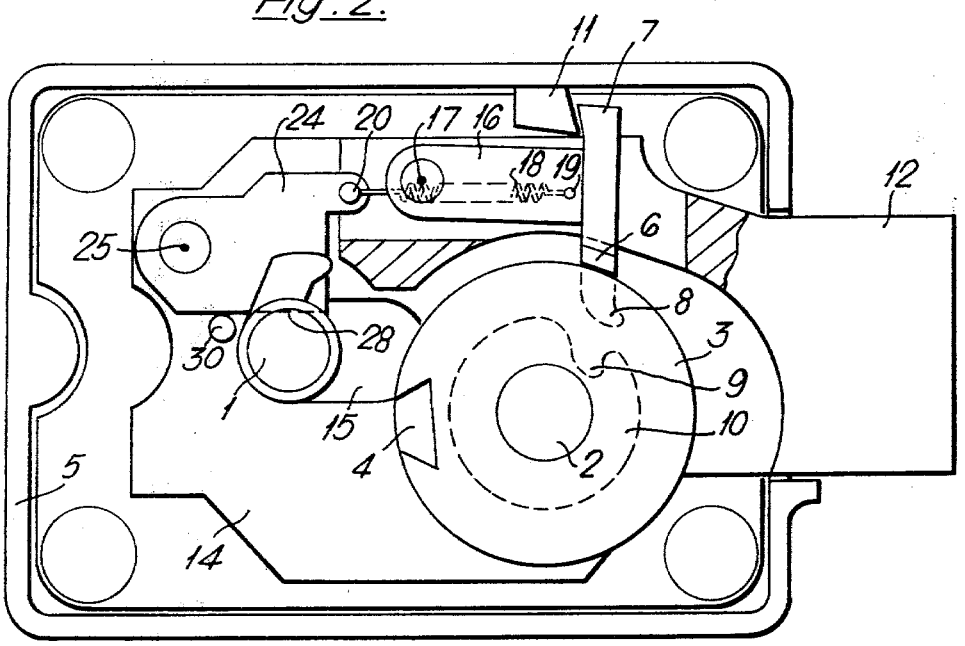
FIGS. 2, 3 and 4 are corresponding views showing successive positions of the components during an unlocking operation.

In the position of FIG. 2, dialling has only just started and the combination wheels are still in a scrambled position, the gate 4, for example, being situated well away from the alignment position. Accordingly, the fence 6 rests on the surfaces of the wheels 3 while the flat 28 is in register with the lever arm 24, but as rotation of the shaft 1 continues, the lever arm 24 is lifted back again to the position of FIG. 1 and the fence 6 and the drop arm 7 thus return to the position of this Figure, again with a snap action.

Figure 3:
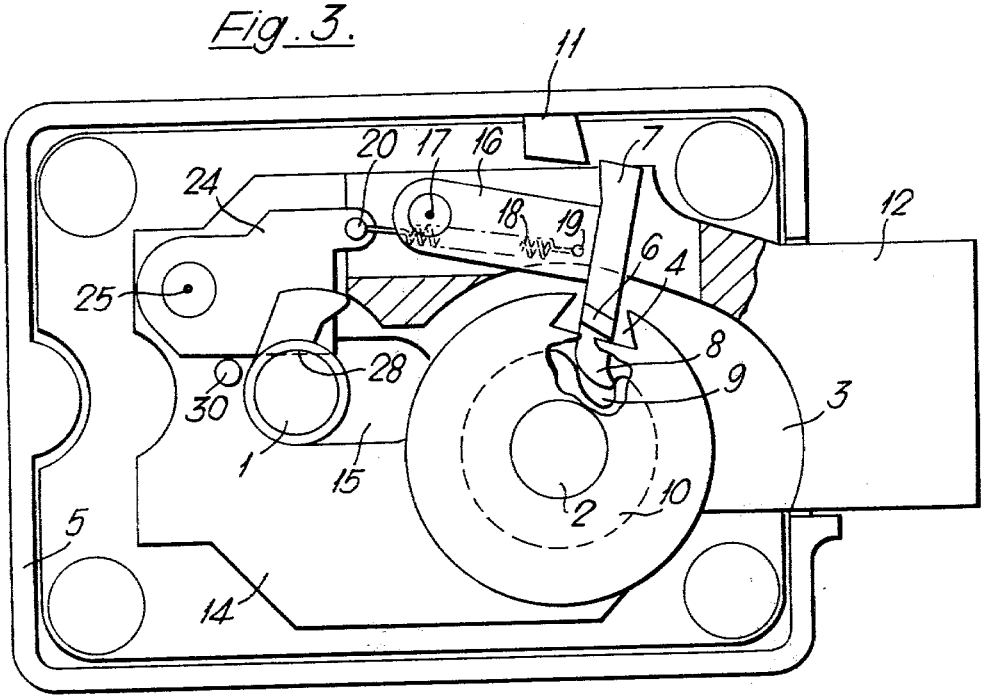
Figure 4:
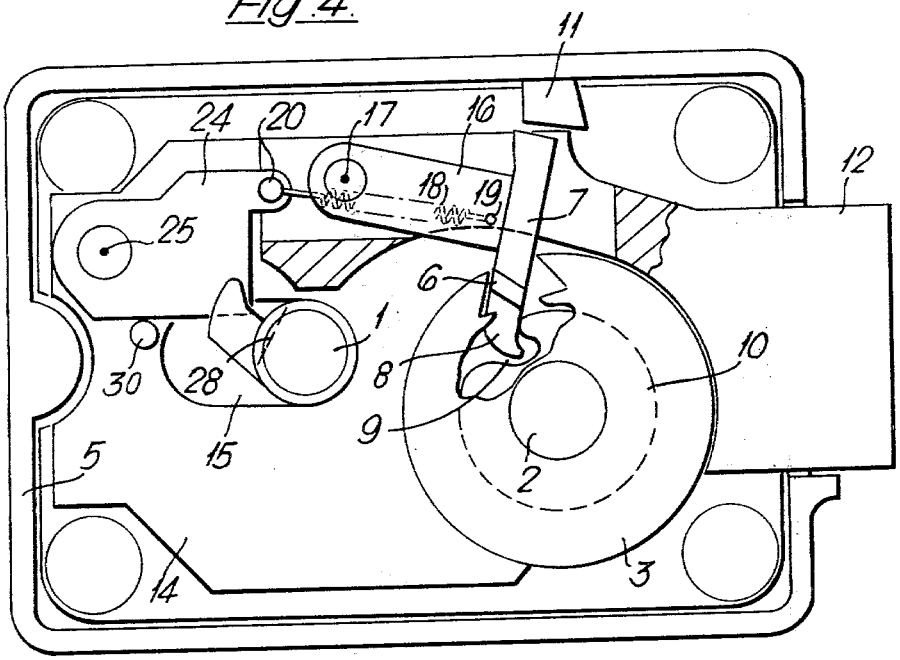
Figure 5:
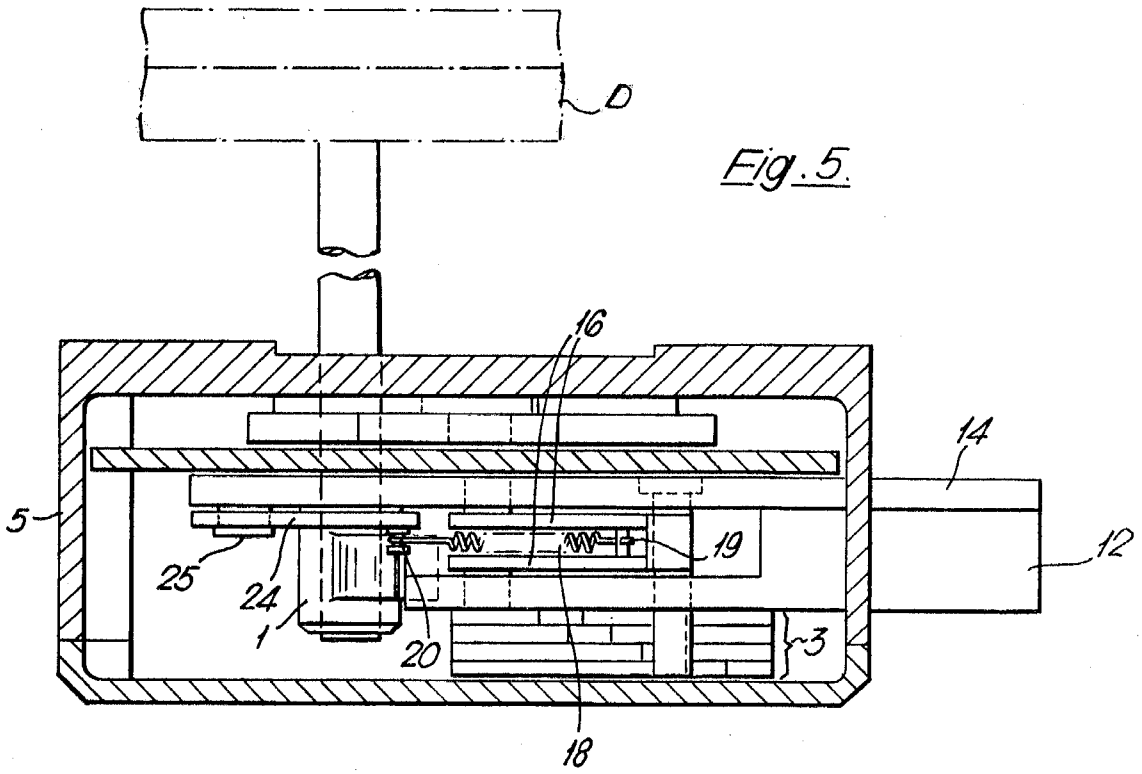
FIG. 5 is a cross-sectional view on the line V—V in FIG. 1.

FIG. 3 shows the position in which dialling has been completed and the gates in the combination wheels are all aligned so that when the fence 6 is lowered under the control of the flat 28, as a result of rotation of the dial as just described, it does not rest on the surfaces of the wheels, but rather enters the gates 4 and thus allows the nose portion 8 of the drop arm 7 to enter the recess 9 of the driver 10 as with a normal construction of lock. Accordingly, on further turning movement of the dial leading to turning movement of the shaft 2 in an anti-clockwise direction, the bolt 12 is retracted as shown in FIG. 4, the lever arm 24 being supported in this position by a stop 30. This part of the operation and subsequent extension of the bolt to the locked position are exactly the same as with a normal construction of lock. As a consequence, an authorised operator is able to operate the lock in exactly the same manner as a normal lock and may not even be aware that there is any difference. Since, during the greater part of the dialling operation the fence 6 will not be in contact with the surfaces of the combination wheels, any manipulator is deprived of any information which he would otherwise have obtained by engagement between the fence 6 and the edges of gates in successive combination wheels. Not only is the operation the same as that for a normal lock, but the snap action mechanism is simpler and more robust than that described in the previous patent specification referred to above.

Modifications to the snap action mechanism are, however, possible without departure from the principles just described. For example, the member 24 may slide in a generally vertical direction in guides under the control of the cam shaft 1 so as to raise and lower the left hand end of the spring 18 in a manner similar to that already described. Moreover, the tension spring 18 could be replaced by a compression spring acting between adjacent portions of the two lever arms so as to produce an over-centre action by causing the line of action of the spring to move from one side to the other of the pivot 17. Although, as previously mentioned, a construction in accordance with the invention is particularly applicable to a combination lock of the offset type, it can also be applied to a lock of the direct drive type.

I claim:

1. In a combination lock comprising a rotary dial, a first shaft coupled to said dial, a plurality of co-axial rotary combination wheels mounted on a second shaft, said first shaft being offset from and drivingly connected to said second shaft, each of said combination wheels being formed with a circumferential notch, a driver cam co-axial with said combination wheels and also controlled by said dial, said driver cam being formed with a recess, a bolt assembly, a drop arm carried by said bolt assembly, a fence connected to said drop arm and co-operating with said combination wheels in such a way that when the notches in said combination wheels have been aligned by operation of said dial, said fence enters said notches and permits said drop arm to enter the recess in said driver cam, whereby further rotation of said dial causes retraction of said bolt assembly, the improvement which comprises an over-center mechanism for moving said fence between first and second positions with a snap action, said fence engaging said combination wheels only in said second position, said over-center mechanism comprising a lever arm about a point on said bolt assembly, a member mounted for movement between first and second positions in relation to said bolt assembly responsive to rotation of said first shaft, a stressed spring having two ends, means connecting a first end of said spring to said lever arm and a second end of said spring to said member, said first position of said member causing the line of action of said spring to pass to one side of the pivot point of said lever arm and said second position of said member causing the line of action of said spring to pass to the other side of the pivot point, whereby, when said member moves from one position to the other said lever arm is biased to move said fence between said first and second positions, and means controlling said member in response to rotation of first shaft in such a way that said fence remains in said first position for the majority of a revolution of said first shaft, being moved to said second position in which it is capable of entering the notches in said combination wheels only for the remaining small fraction of a revolution.

2. A combination lock according to claim 1 in which said member engages directly with the surface of said first shaft.

3. A combination lock according to claim 2 in which said first shaft is formed with a flat engaged by said member during part of a revolution of said first shaft.

4. A combination lock according to claim 1, in which said stressed spring is a tension spring connected to said lever arm at a point remote from said pivot point and extending past said pivot point to said member.

5. A combination lock according to claim 4 including means pivoting said member to said bolt assembly.

6. A combination lock according to claim 1 wherein said second shaft is proximate to the bolt assembly and wherein both said first shaft and member movable between first and second positions are offset to the side of said second shaft remote from the bolt assembly.

* * * * *